US005207144A

United States Patent [19]

Sporrer et al.

[11] Patent Number: 5,207,144

[45] Date of Patent: May 4, 1993

[54] SWASHPLATE LEVELING DEVICE

[75] Inventors: Ronald J. Sporrer; Scott D. Meyer, both of Ames, Iowa

[73] Assignee: Sauer, Inc., Ames, Iowa

[21] Appl. No.: 693,160

[22] Filed: Apr. 29, 1991

[51] Int. Cl.[5] ..... F01B 3/00

[52] U.S. Cl. ..... 92/12.2; 91/505

[58] Field of Search ..... 91/475, 505, 506; 92/12.2, 57, 70, 71

[56] References Cited

U.S. PATENT DOCUMENTS

| | | | |
|---|---|---|---|
| 4,283,962 | 8/1981 | Forster | 91/505 |
| 4,584,926 | 4/1986 | Beck et al. | 91/506 |
| 4,845,949 | 7/1989 | Shivvers | 60/442 |

OTHER PUBLICATIONS

Noy, P.C. "Ways to Prevent Overloading" in: Mechanisms, Linkages, and Mechanical Controls (McGraw Hill, 1965), p. 266.

*Primary Examiner*—Edward K. Look
*Assistant Examiner*—F. Daniel Lopez
*Attorney, Agent, or Firm*—Zarley, McKee, Thomte, Voorhees & Sease

[57] ABSTRACT

A swashplate leveling device has a reciprocative leveling follower movable along a fixed axial pin. The cam is biased into engagement with a swashplate of an axial piston variable displacement hydraulic unit to position the swashplate in a zero displacement orientation when there is no control input to the hydraulic unit. The leveling device has a pair of contact points, one positioned on each side of the swashplate tilt axis in a manner that both contact points engage the swashplate when it is leveled to its zero displacement orientation.

6 Claims, 2 Drawing Sheets

SWASHPLATE LEVELING DEVICE

TECHNICAL FIELD

This invention relates to a device for leveling a swashplate in a variable displacement hydraulic unit and, more specifically, to a simple leveling device for accurately holding a swashplate in a zero displacement orientation.

BACKGROUND ART

In variable displacement hydraulic units, especially pumps of either the single flow direction type or the reversible flow type, it is desirable to have means which maintain the position of the swashplate in a zero displacement orientation when there is no control input to move the swashplate to a stroking position.

A known hydraulic unit of the variable displacement type has a rotating cylinder block with pistons axially movable therein. The displacement of the hydraulic unit is proportional to the stroke of the pistons within the cylinder block. Where the hydraulic unit is of the axial piston type, the pistons engage a tiltable swashplate to vary the stroke of the pistons. When the swashplate is perpendicular to the axis of the cylinder block, the swashplate is in a neutral or a zero displacement orientation and the hydraulic unit has no output.

Hydraulic units of the variable displacement type commonly are employed in hydrostatic transmissions used in utility vehicles, such as garden tractors and the like. When the swashplate of the hydraulic unit is in the neutral position and the hydraulic unit has no output, the vehicle power supply is disconnected from the drive train and movement of the vehicle is prohibited. Vibration and fluid affects can result in the perturbation of the swashplate from the neutral position, however, generating a fluid displacement within the hydraulic unit. The vehicle power supply and drive are thus interconnected and the vehicle begins to creep in either a forward or reverse direction. This can be particularly dangerous in situations where the vehicle has been left unattended. It therefore is an important characteristic of a hydraulic unit that the swashplate be accurately leveled when the a condition of no output from a hydrostatic transmission is desired.

Various swashplate leveling devices have had limited success in maintaining a swashplate in its zero displacement orientation in the absence of external control forces. Forster et at U.S. Pat. No. 4,142,452, dated Mar. 6, 1979 discloses a cradle type swashplate resting in a roller bearing pocket and having four prestressed springs within the pistons of a hydraulic servo unit. In order to properly position the swashplate, very accurate spring lengths or adjustment thereof are required to minimize backlash and insure that the leveling force of a given spring does not start until the swashplate is tilted toward that spring but still assures that the spring starts to act on the swashplate exactly when the swashplate is in the zero displacement position. The use of plural springs causes problems due to the inconsistent properties of the springs.

One approach to solving the problem of inconsistent spring properties has been to provide a guide means for controlling the movement of a leveling device. U.S. Pat. No. 4,584,926 to Beck et al discloses a dual-spring biased cam having a pair of axial slots which receive pins that are fixed to a side cover for guiding the movement of the cam. Although the leveling device shown by Beck has been used for years, the design is somewhat mechanically complex and expensive to manufacture.

U.S. Pat. No. 4,845,949 to Shivvers et al shows an annular neutral mechanism which is mounted on a pump drive shaft. Because the pump shaft rotates, the mechanism is free to move relative to the shaft. In order to control the motion of the annular mechanism, a bore is formed in a pump side section which frictionally engages the outside diameter of the mechanism and limits the efficiency thereof. The Shivvers construction also requires that the neutral mechanism be positioned on the side of the swashplate opposite the rotating cylinder block. The overall length of the hydraulic unit must be appropriately increased to accommodate the travel of the neutral mechanism, resulting in a design imposing restrictive packaging problems.

A need remains for a swashplate leveling device for the swashplate of a variable displacement hydraulic unit, which is simple to manufacture and provides accurate positioning of the swashplate. The present invention is directed toward satisfying this need and overcoming one or more of the problems discussed above.

SUMMARY OF THE INVENTION

An object, therefore, of the invention is to provide a new and improved swashplate leveling device for accurately maintaining the swashplate of a variable displacement hydraulic unit in a zero displacement orientation in the absence of external control forces.

In the exemplary embodiment of the invention, a swashplate leveling device includes a reciprocal leveling follower which is axially movable along a pin fixed within a housing. The reciprocal follower is biased into engagement with a planar cam surface on a swashplate of an axial piston variable displacement hydraulic unit to position the swashplate in a zero displacement orientation when there is no control input to the hydraulic unit. The leveling device has a pair of contact points, one positioned on each side of the swashplate tilt axis in a manner that both contact points engage the swashplate when it is leveled to its zero displacement orientation.

The variable displacement hydraulic unit with which the exemplary swashplate leveling device is used has a housing and a cylinder block rotatable in the housing about an axial centerline, with pistons axially movable in the housing. The swashplate is tiltable about a transverse axis perpendicular to the cylinder block centerline and has a surface engageable by the pistons to control the stroke of the pistons within the cylinder block.

The reciprocal follower is a substantially T-shaped member having a pair of oppositely directed arms which extend outwardly from a central depending stem portion. The stem portion has an opening extending therethrough for slidably receiving the pin, with the opening having a centerline which is offset from and substantially parallel to the centerline of the rotatable cylinder block. The contact points are formed at distal ends of the oppositely directed arms, with the reciprocative follower engaging the same surface of the tiltable swashplate or cam as that engaged by the pistons.

The reciprocal follower is biased for axial movement by means of a coil spring interposed between the reciprocal follower and the housing. The coil spring has a spring stiffness sufficient to maintain the swashplate in the zero displacement orientation in the absence of an external control force, while permitting the retention of a prescribed non-zero displacement orientation of the swashplate.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
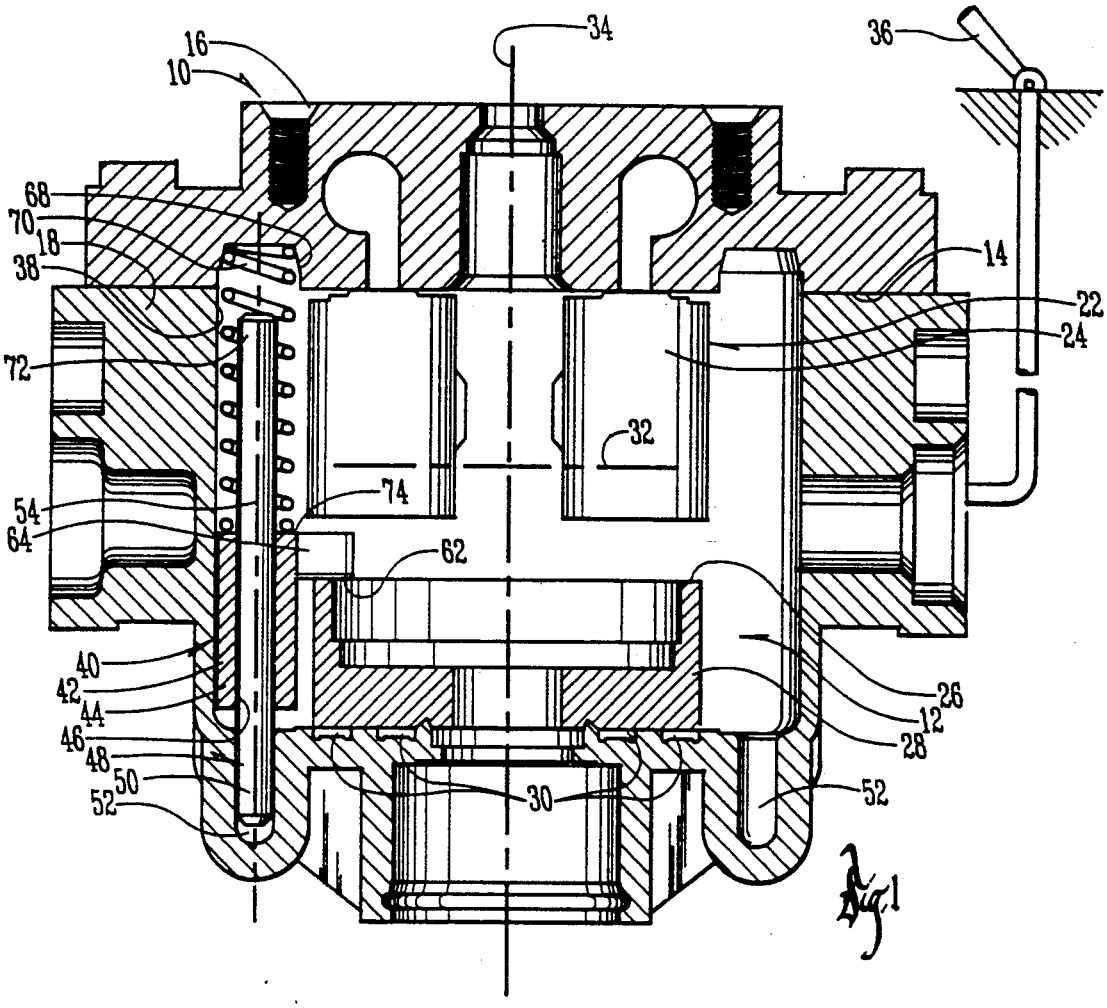
FIG. 1 is a sectional view of a hydraulic unit having the swashplate leveling device of the present invention.
Figure 2:
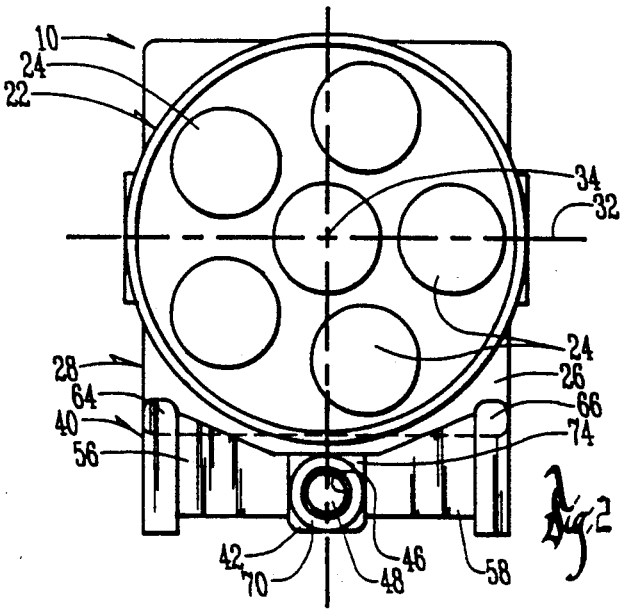
FIG. 2 is a top plan view of the hydraulic unit and swashplate leveling device shown in FIG. 1.

Referring first to FIGS. 1 and 2, there is shown generally at 10 a portion of a transmission having an axial piston hydraulic unit 12 mounted on a running surface 14 of a transmission centersection 16 which abuts a portion of a transmission case 18. The centersection and a transmission case 18 together define a closed housing which envelops a rotatable cylinder block 22 having a plurality of axially sliding pistons 24 located therein. Each piston engages a planar tiltable stroke surface 26 of a cradle-type swashplate 28. The swashplate is mounted on a plurality of rotatable bearing elements (not shown) carried within semi-circular raceways 30 for tiltable movement of the swashplate about a transverse swashplate axis 32 which is perpendicular to a cylinder block axis or centerline 34. Such axial piston hydraulic units using a cradle swashplate are known in the art, and the particular structure of the parts heretofore described are not material to the present invention.

As is generally known, the displacement of hydraulic unit 12 is proportional to the stroke of pistons 24 within cylinder block 22. The pistons engage tiltable stroke surface 26 of tiltable swashplate 28, such that the tilt angle of the swashplate is operative to vary the stroke of the pistons and thus vary the displacement of the hydraulic unit. Tilting of the swashplate, as prescribed, for example by manual activation of an operator control 36 to port a differential fluid pressure to opposite sides of the swashplate, results in a non-zero displacement of the hydraulic unit. When tiltable stroke surface 26 is perpendicular to axis 34 of the cylinder block, the swashplate is in a neutral or a zero displacement orientation and hydraulic unit 12 has no output. The swashplate leveling device of the present invention applies a force to opposite sides of the swashplate to maintain the swashplate in a zero displacement orientation in the absence of an external control force.

Figure 4:
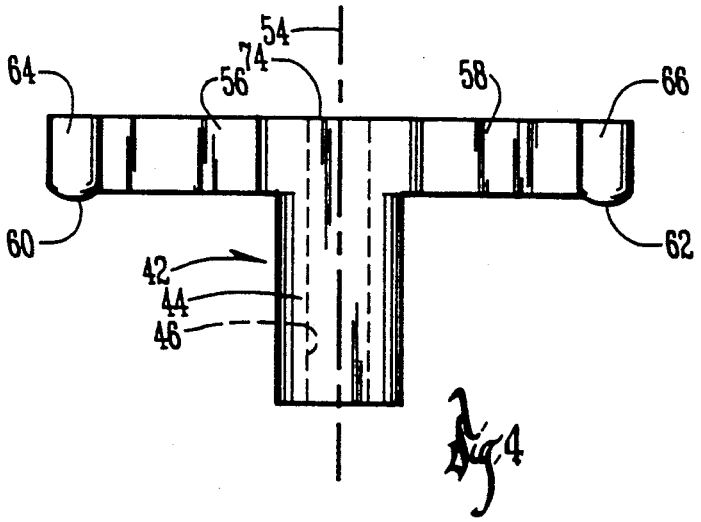
FIG. 4 is an isolated elevational view of the reciprocal follower illustrated in the swashplate leveling device of FIG. 3.

The preferred form of a leveling device according to the invention now will be described. Located at the left side of hydraulic unit 12, as viewed in FIG. 1, is a bore 38 which mounts the leveling device, shown generally at 40. The swashplate leveling device includes a reciprocal follower 42 (FIG. 2) which is axially movable within bore 38. As best seen in FIG. 4, reciprocal follower 42 is substantially T-shaped and has an elongated stem portion 44 with a cylindrical opening 46 for slidably receiving a pin 48. The pin is fixedly mounted by means of a press fit at an end 50 thereof into a pocket 52 formed in transmission case 18 and has a longitudinal axis 54 offset from and extending substantially parallel to cylinder block centerline 34.

Reciprocal follower 42 also has a pair of oppositely directed arms 56 and 58 extending outwardly from stem portion 44 and substantially perpendicular to pin axis 54. The outer end of each arm 56 and 58 has a rounded contact point 60 and 62, respectively, in a plane substantially perpendicular to axis 54 and designed to engage two corners 64 and 66, respectively, on tiltable stroke surface 26 of swashplate 28.

A spring seat 68 is formed on centersection 16 substantially aligned with axis 54 of pin 48. The spring seat provides a mounting for a coil spring 70 which surrounds pin 48 at a free end 72 thereof and abuts an end surface 74 of reciprocal follower 42.

Figure 3:
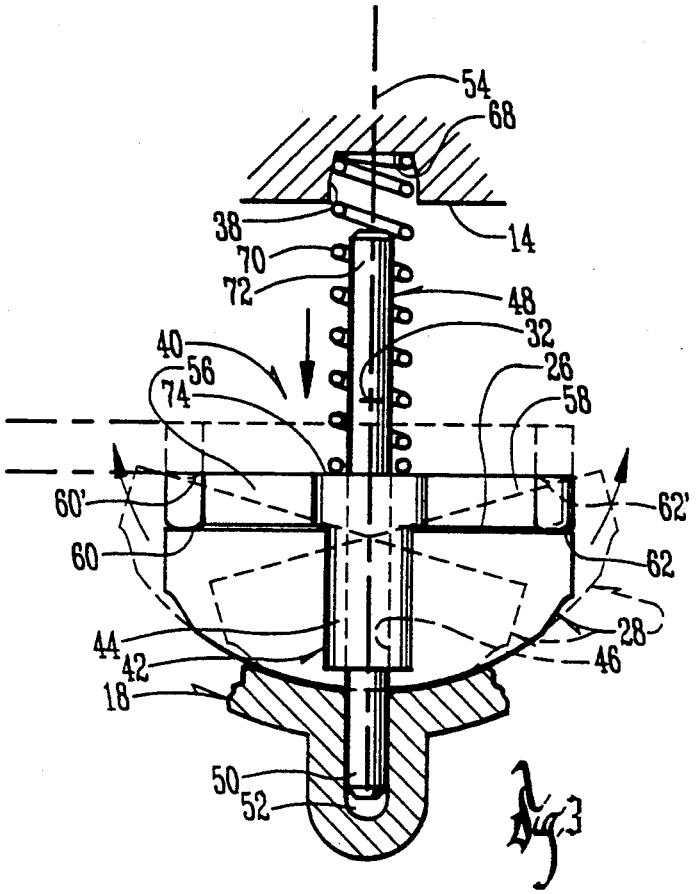
FIG. 3 is a side elevational view of the swashplate and the swashplate leveling device shown in FIG. 1, with a zero displacement orientation of the swashplate shown in solid lines and a non-zero displacement orientation thereof shown in dashed lines.

Spring 70 provides a downward axial biasing force, as shown by arrow "A" in FIG. 3, on reciprocative follower 42 to bring at least one of the contact points 60 or 62 into engagement with swashplate 28. Since axis 54 of the pin is substantially parallel to axis 34 of the cylinder block, the follower can move downwardly until both points 60 and 62 contact the swashplate, at which time the planar tiltable stroke surface 26 of the swashplate 28 is perpendicular to the cylinder block 22. Under such condition (herein referred to as a zero displacement condition) rotation of the cylinder block does not generate flow if hydraulic unit 12 is a pump and produces zero torque output if hydraulic unit 12 is a motor.

In FIG. 3, swashplate 28 and follower 42 are shown in solid lines when in the zero displacement orientation. However, when swashplate 28 is tilted clockwise about axis 32, left corner 64 of tiltable stroke surface 26, which is in engagement with contact point 60, forces the follower to move upward against the bias of coil spring 70. This upper position is represented by the contact point 60'. Because of the rigidity of pin 48 and the elongation of stem 44, the follower moves bodily in a linear direction along axis 54, without tilting. Since the whole follower moves upwardly, contact point 62 no longer is in contact with right corner 66 of the follower surface which has tilted away from the cam. Similarly, counterclockwise rotation of swashplate 28, such as a reverse mode of operation, causes right corner 66 to move the follower upwardly, but with right contact point 62 now in engagement with the swashplate. When the swashplate is in either the clockwise or counterclockwise position as described above, the reciprocal follower still is biased downwardly by the coil spring so as to bias the swashplate toward a level position, that is, with the piston-riding tiltable stroke surface 26 perpendicular to axis 34 of the cylinder block when no input control forces are applied to swashplate control lever 36.

In such a level or neutral position, both contact points 60 and 62 engage the tiltable stroke surface of swashplate 28 to retain the swashplate in the zero displacement orientation. Since contact points 60 and 62 are maintained perpendicular to follower axis 54 and centerline 34, and since both contact points are part of follower 42 which is constrained to move only along follower axis 54, there is no relative movement between contact points 60 and 62. Thus, swashplate 28 is leveled to the zero displacement orientation. It should be understood that while spring 70 has a stiffness sufficient to retain swashplate 28 in the zero displacement orientation in the absence of an external control force, the spring is not designed to return the swashplate from a stroked position. That is, spring 70 ensures that swashplate 28 will not creep away from the zero displacement condition. However, when control forces are removed from operator control 36 with the swashplate at a prescribed non-zero displacement orientation, the swashplate will retain the desired orientation. Thus, leveling device 40 serves as a neutral assist to eliminate creep while developing a minimal impact on the control forces required to position the swashplate.

It can be noted that since spring 70 does not directly engage swashplate 28, but only tiltable stroke surface corners 64 and 66, there are no problems with backlash as with the spring systems of previous designs. Furthermore, with the present invention, any change in spring characteristics during use, or improper adjustment of the spring at the time of manufacture, does not cause tilting of the swashplate from its zero displacement orientation.

Another advantage of the present design is that the swashplate leveling device is located offset to one side of the swashplate, allowing the leveling device to be positioned on the same side of the swashplate as the rotatable cylinder block. Rather than acting on an opposite side of the swashplate, follower 42 engages the same side of swashplate 28 as pistons 24, allowing a more compact, easily-packaged hydraulic unit.

Further, the present invention is well adapted to be manufactured easily and inexpensively. Rather than employing several guide members upon which the follower is mounted, the follower is constrained to slide along only a single pin which is press fit into the transmission housing. No additional fasteners are required to mount the pin or the biasing spring, and the follower need only be formed with a single central opening. The simple design results in lower machining costs and ultimately a lower cost device.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A swashplate leveling device for a variable displacement hydraulic unit which has a housing, a cylinder block rotatable in the housing about a first axial centerline and having pistons axially movable therein, a swashplate tiltable about a transverse axis perpendicular to the first centerline and having a surface engageable by the pistons to control the stroke of the piston within the cylinder block, the leveling device comprising:

an elongated pin fixedly mounted on the housing and having a longitudinal axis defining a second axial centerline offset from and extending substantially parallel to the first axial centerline;

a reciprocal follower slidably mounted on the pin for movement between a first position for engaging the swashplate to maintain the swashplate in an orientation representative of a zero displacement of the hydraulic unit, and a second position wherein the swashplate tilted under the influence of an external force.

2. The swashplate leveling device of claim 1 in which the reciprocal follower has a pair of spaced apart contact points for engaging said swashplate one disposed on each side of said transverse axis.

3. The swashplate leveling device of claim 2 in which the hydraulic unit is reversible, with the swashplate being tiltable in opposite directions about the transverse axis from the zero displacement orientation, the swashplate engaging only one of the contact points on the reciprocal follower when the swashplate is tilted in one direction and the swashplate engaging only the other of the contact points on the reciprocal follower when the swashplate is tilted in the opposite direction.

4. The swashplate leveling device of claim 2 in which the surface engaged by the pistons for controlling the stroke of the piston within the cylinder block is a tiltable stroke surface, with the contact points on the reciprocal follower contacting the swashplate on the tiltable stroke surface, such that the contact points on the reciprocal follower and the rotatable cylinder block are located on the same side of the swashplate.

5. A swashplate leveling device for a variable displacement hydraulic unit which has a housing, a cylinder block rotatable in the housing about a first axial centerline and having pistons axially movable therein, a swashplate tiltable about a transverse axis perpendicular to the first centerline and having a surface engageable by the pistons to control the stroke of the piston within the cylinder block, the leveling device comprising:

an elongated pin fixedly mounted on the housing and defining a second axial centerline offset from and extending substantially parallel to the first axial centerline;

a reciprocal follower slidably mounted on the pin for movement between a first position for engaging the swashplate to maintain the swashplate in an orientation representative of a zero displacement of the hydraulic unit, and a second position wherein the swashplate tilted under the influence of an external force; and a coil spring interposed between said reciprocal follower and the housing, surrounding the pin and having a stiffness sufficient to maintain the swashplate in the zero displacement orientation in the absence of an external control force, the spring stiffness permitting the retention of a prescribed non-zero displacement orientation of the swashplate in the absence of an external control force.

6. A swashplate leveling device for a variable displacement hydraulic unit which has a housing, a cylinder block rotatable in the housing about a first axial centerline and having pistons axially movable therein, a swashplate tiltable about a transverse axis perpendicular to the first centerline and having a surface engageable by the pistons to control the stroke of the piston within the cylinder block, the leveling device comprising:

said housing including a pocket and a cavity formed therein having parallel longitudinal axes, said cylinder block being rotatable in said cavity and a pin being press fitted into said pocket whereby said pin and cylinder block have parallel longitudinal axes, and a reciprocal follower slidably mounted on the pin for movement between a first position for engaging the swashplate to maintain the swashplate in an orientation representative of a zero displacement of the hydraulic unit, and a second position wherein the swashplate is tilted under the influence of an external force.

* * * * *

UNITED STATES PATENT AND TRADEMARK OFFICE

CERTIFICATE OF CORRECTION

PATENT NO. : 5,207,144
DATED : May 4, 1993
INVENTOR(S) : Ronald J. Sporrer and Scott D. Meyer It is certified that error appears in the above-identified patent and that said Letters Patent is hereby corrected as shown below:

Title page, "[73]" should be shown as follows:
- [73] Assignee: Sauer Inc., Ames, Iowa -

Signed and Sealed this

Thirty-first Day of July, 2001

*Attest:*

Nicholas P. Godici

*Attesting Officer*

NICHOLAS P. GODICI
*Acting Director of the United States Patent and Trademark Office*